United States Patent [19]

Shull

[11] Patent Number: 4,581,958

[45] Date of Patent: Apr. 15, 1986

[54] EXTENSIBLE HANDLE ASSEMBLY FOR RATCHET WRENCH OR THE LIKE

[76] Inventor: Foye M. Shull, R.F.D. #2, Box 1235, Oviedo, Fla. 32765

[21] Appl. No.: 744,081

[22] Filed: Jun. 11, 1985

[51] Int. Cl.[4] ..... B25B 13/00

[52] U.S. Cl. ..... 81/177.2; 403/109

[58] Field of Search ..... 81/177.2, 177.1, 60, 81/61, 62, 63, 63.1, 63.2; 403/109

[56] References Cited

U.S. PATENT DOCUMENTS

| | | | |
|---|---|---|---|
| 2,869,410 | 1/1959 | Prichard | 81/63 |
| 3,526,040 | 9/1970 | Young | 403/108 |
| 4,070,932 | 1/1978 | Jeannette | 81/177.2 |
| 4,079,978 | 3/1978 | McMullin | 403/109 |
| 4,376,397 | 3/1983 | Newby et al. | 403/109 |

*Primary Examiner*—James L. Jones, Jr.
*Attorney, Agent, or Firm*—Duckworth, Allen, Dyer & Pettis

[57] ABSTRACT

An extensible handle assembly for a ratchet wrench or similar tool includes a tubular handle member with a central hole down its length and a tool-engaging shank extending through the central hole of the handle member. The shank is slidable in the handle member between extended and retracted positions, and includes a detent to engage the shank at each of those positions. A plug that extends through the central hole from the rearward end of the handle member permits disassembly of the shank from the handle member, restricts movement of the shank outwardly from the forward end of the handle member and restricts axial rotation of the shank.

13 Claims, 8 Drawing Figures

EXTENSIBLE HANDLE ASSEMBLY FOR RATCHET WRENCH OR THE LIKE

BACKGROUND OF THE INVENTION

1. Field of the Invention

The present invention relates generally to hand tools, and particularly relates to extensible handles for ratchet wrenches and similar tools.

2. Description of the Prior Art

It is known to provide an extensible handle for ratchet wrenches and similar tools having a elongated shank, in order to permit the operator to increase the amount of torque exerted during the use of the tool. Examples of prior art extensible handles are discussed in the following patents:

Carlberg, in U.S. Pat. No. 2,382,291, discloses an extensible hand tool having a handle member with a tool-engaging shank slidable into and out of the handle member, with the handle member having an enclosed rearward end. A detent mechanism is provided in the Carlberg device for permitting the shank to be located at different positions along the path of travel.

Condor, U.S. Pat. No. 2,438,633, likewise discloses a shank extensible into and out of a handle member. A spring loaded projection in a hole along the periphery of the shank restricts the extreme outward movement of the shank from the handle member.

Prichard, in U.S. Pat. No. 2,869,410, also discloses an extensible ratchet wrench handle with an enlosed rearward end.

Jeannotte, in U.S. Pat. No. 4,070,932, discloses an extensible handle for a tool headpiece, in which the extension member is operated by a coil spring at the forward end of the tool shank. Like the references disclosed above, Jeannotte teaches a handle member having an enclosed rearward end.

Gentry, in U.S. Pat. No. 4,307,634, discloses a telescoping nut driver with the rearward end of the handle member closed, and with various locking features extending through the side periphery of the handle member into the shank.

Newby et al., in U.S. Pat. No. 4,376,397, disclose a drive mechanism including a detent and a restricting pin along the periphery of the shank to restrict outward movement of the shank.

Potter et al., in U.S. Pat. No.4,440,517, disclose an adjustable torque-multiplier breaker bar assembly with an open rearward end which is attached to a rod with a handle at its rearward extremity in order to provide greater torque.

Other prior art of interest is found in Class 81, subclasses 60 and 177 in the search records of the United States Patent and Trademark Office.

SUMMARY OF THE INVENTION

The present invention provides an extensible handle assembly for a ratchet wrench or other similar tool, with means at the rearward extremity of the handle assembly for permitting easy disassembly of the tool shank from the handle member, which means further restricts the extension of the tool shank from the handle member and prevents axial rotation of the shank.

In accordance with the present invention, the extensible handle assembly includes a tubular handle member having forward and rearward ends and a central hole extending down its length between the forward and rearward ends. The assembly further includes a tool-engaging shank having forward and rearward ends extending through, the shank dimensioned to closely fit in the central hole of the handle member, the shank being longer than the handle member. The shank is slidable in the handle member between a retracted position with the rearward end of the shank adjacent the rearward end of the handle member and an extended position with the rearward end of the shank positioned toward the forward end of the handle member. The shank is provided with a tool-engaging means along the forward end thereof.

The extensible handle assembly further includes means extending through the central hole from the rearward end of the handle member for permitting disassembly of the shank from the handle member. Preferably, removal of the shank is prevented until after removal of the disassembly means.

Further in accordance with the present invention, the disassembly means extending through the central hole from the rearward end of the handle member further restricts the outward extension of the shank beyond the extended position, and prevents axial rotation of the shank in the central hole.

In the preferred embodiment of the present invention, the disassembly and restricting means comprise a plug which fits into the rearward end of the handle and is fastened to the rearward extremity of the tool shank. The plug includes a peripheral shoulder which is dimensioned to pass through the central hole of the handle member and engage a corresponding should along the periphery of the central hole to thereby prevent the tool shank from extending further outside of the handle member. The plug preferably includes a flat surface along its periphery which engages a flat surface of the central hole of the handle member, to thereby restrict axial rotation of the tool shank.

Disassembly of the tool shank from the handle member is easily facilitated by removing the fastener engaging the plug to the rearward end of the shank, permitting the plug to be removed from the rearward end of the handle member, and permitting the shank to be pulled completely out of the handle member at the forward end thereof. Means are provided for locking the plug with the shank for axial rotation.

DESCRIPTION OF THE DRAWINGS

The preferred embodiment of the extensible handle assembly in accordance with the present invention will be described below with reference to the drawings, in which.

DESCRIPTION OF THE PREFERRED EMBODIMENT

Figure 1A:
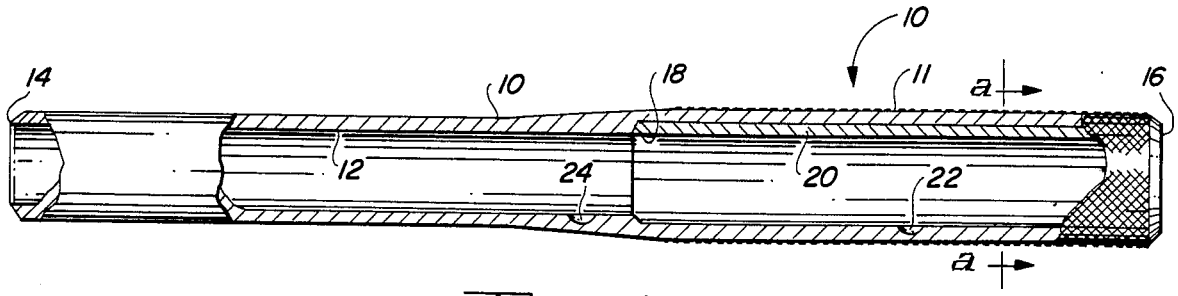
FIG. 1A illustrates a side view of the handle member of the present invention, in cross-section.
Figure 1B:
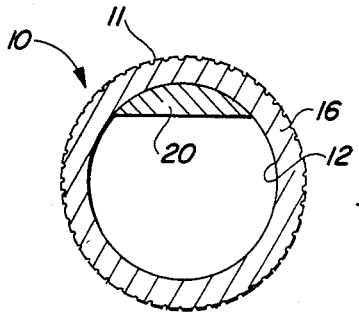
FIG. 1B illustrates a cross-sectional view of the handle member of FIG. 1A, along the lines a—a.

Referring to FIGS. 1A and 1B, the extensible handle assembly of the present invention includes a tubular handle member 10 having an outer, knurled surface 11 with a central hole 12 extending down the length of the handle member 10 between the forward end 14 and the rearward end 16 thereof. The central hole 12 along the rearward portion is of a greater dimension than at the forward extemity, so as to create a shoulder 18 between the two portions thereof. A flat surface 20 extends along the rearward portion of greater cross-sectional area to the rearward end 16 of the handle member 10; the flat surface 20 is seen from the end view of FIG. 1B. The flat surface 20 may be formed by a metal strip brazed or soldered to the periphery of the hole 12, or the handle member 10 may be forged with the flat surface 20 integrally formed with the handle member. The handle member 10 includes two detent notches, one notch 22 near the rearward end 16 and the other notch 24 forwardly of the shoulder 18.

Figure 2:
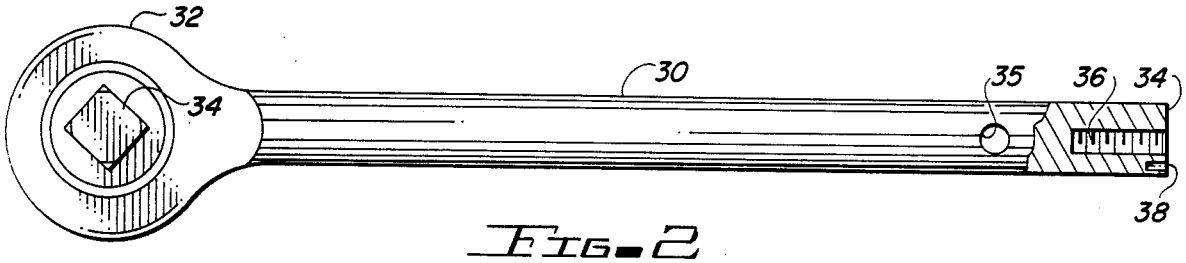
FIG. 2 illustrates the tool shank of the assembly, with a portion shown in cross-section.

The extensible handle assembly of the present invention further includes a tool-engaging shank 30, shown in FIG. 2. The shank 30 is dimensioned to fit within the central hole 12 and has a forward end 32 to which a tool-engaging member 34 (such as a ratchet lug) is attached. The shank 30 further includes a rearward end 34 and a detent hole 36 therein. A threaded fastening hole 36 extends from the rearward end 34 axially into the shank 30, and a locking pin hole 38 extends into the rearward end 34 of the shank 30 and generally parallel with the threaded hole 36.

Figure 3A:
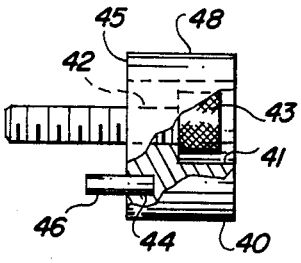
FIGS. 3A, B and C illustrate, respectively, the side, front and rear views of the rearward plug of the assembly, with the locking pin feature shown in FIGS. 3A and 3B.
Figure 3B:
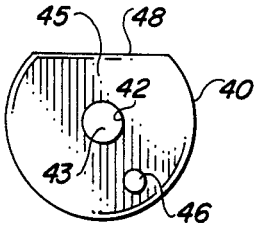
Figure 3C:
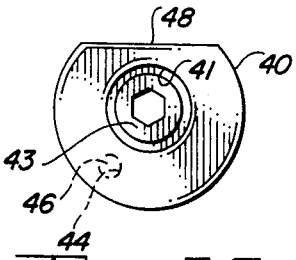

A plug 40 in accordance with the preferred embodiment of the present invention is shown in FIGS. 3A, B and C. The plug 40 includes an indent 41, and a hole 42 through which a fastener, such as a screw 43, is extended to engage the threaded hole 36 in the shank 30. The plug 40 includes a locking pin hole 44 adapted to engage a locking pin 46. A flat surface 48 along the periphery of the plug 40 corresponds in dimension to the flat surface 20 extending through the central hole 12 of the handle member 10. The overall dimension of the plug 40 is such that a shoulder 45 is defined of sufficient outer dimension so as to slide through the portion of the central hole 12 in the handle member 10 of greater dimension, but with the plug 40 being restricted from further forward movement toward the forward end 14 of the handle member 10 by engagement of the shoulder 45 on the plug 40 with the shoulder 18 on the handle member 10. This function will be described in greater detail below with reference to FIG. 5.

Figure 4:
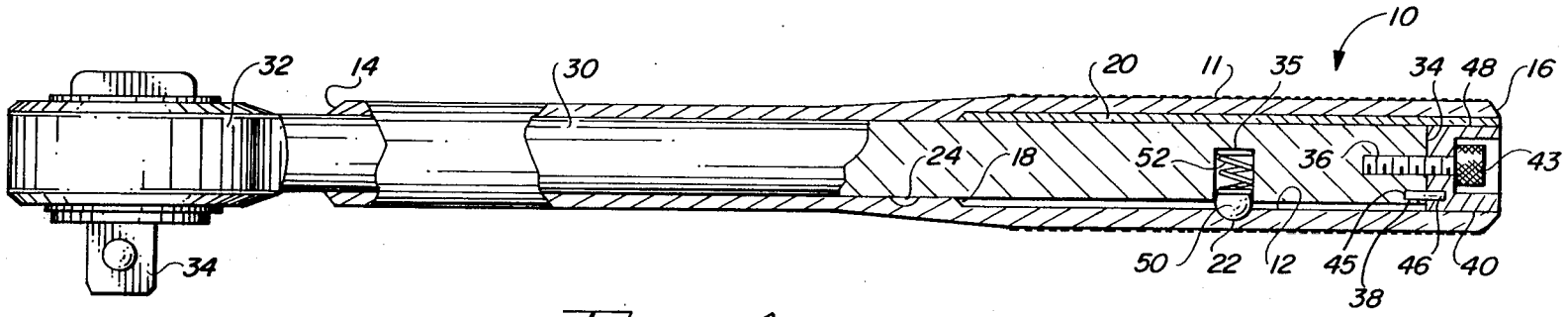
FIG. 4 is a side view, partially in cross-section, of the extensible handle assembly of the present invention, with the tool shank shown in the retracted position.

The handle assembly is shown in an assembled condition in FIG. 4, and with the shank 30 in a retracted position such that the rearward end 34 thereof is adjacent the rearward end 16 of the handle member 10. The assembly further includes a detent ball 50 and a detent spring 52, both positioned in the hole 35 along the outer periphery of the shank 30. The plug 40 is positioned in the central hole 12 with the fastener 43 extending through the hole 42 (FIG. 3A) and fastened to the shank 30 in the threaded hole 36. Similarly, the locking pin 46 is engaged in the locking hole 38 (FIG. 2). Likewise, the flat surface 48 of the plug 40 abuts the flat surface 20, while the shoulder 45 of the plug 40 is open for sliding through the portion of the central hole 12 of greater dimension.

Figure 5:
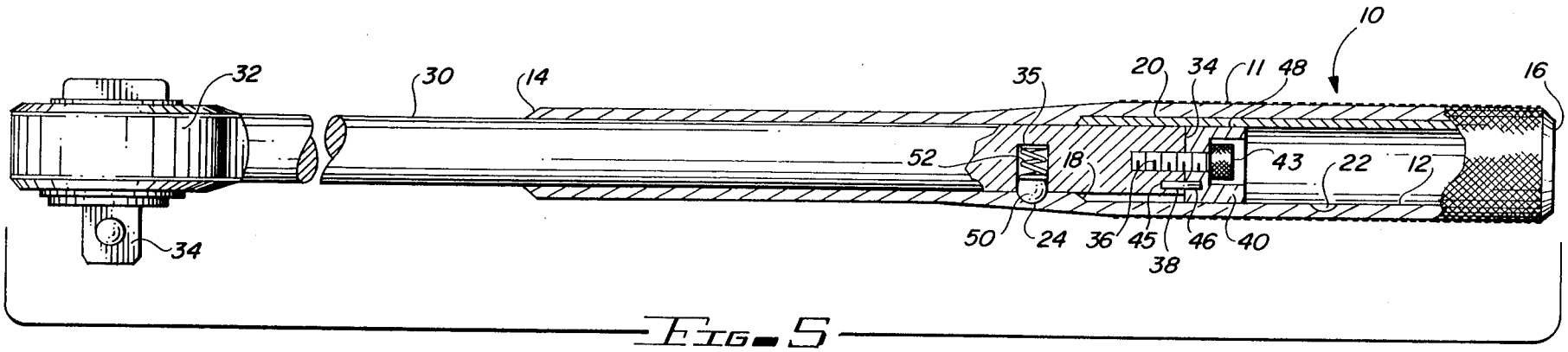
FIG. 5 is a side view of the extensible handle assembly in the extended position, partially in cross-section.

Reference is now made to FIG. 5, where the extensible handle assembly is shown in the extended position. This is achieved by pulling the shank 30 outwardly from the forward end of the handle member 10, to permit the detent ball 50 to cam out of the detent hole 22 in the handle member, and re-engage the detent hole 24 further along the central hole 12 in the handle member 10. Axial rotation of the shank 30 is restricted because of the flat surface 48 being in engagement with the flat surface 20. It will also be appreciated by those skilled in the art that the shank 30 is restricted from further movement out of the forward end 14 of the handle member 10 when the shoulder 45 of the plug 40 engages the shoulder 18 of the handle member 10. Further, the locking pin 46 prevents the shank 30 from moving axially relative to the plug 40. It will be appreciated that alternative features for locking the plug 40 and the shank 30 together may also be used; for example, a key-keyway combination along the mating surfaces of the shank 30 and plug 40 which achieve the same objective.

While the present invention has been described above with reference to the preferred embodiment, it will be understood that various changes and modifications may be made without departing from the spirit and scope of this invention.

What I claim is:

1. An extensible handle assembly for a ratchet wrench or the like, said handle assembly comprising:

(a) a tubular handle member having forward and rearward ends and a central hole extending down its length between said ends;

(b) a tool-engaging shank having forward and rearward ends extending through, and dimensioned to closely fit in said central hole of said handle member, said shank being longer than said handle member and said shank being slidable in said handle member between a retracted position with said rearward end of said shank adjacent said rearward end of said handle member, and an extended position with said rearward end of said shank positioned toward said forward end of said handle member;

(c) a tool-engaging member along said forward end of said shank; and (d) means extending through said central hole from said rearward end of said handle member for permitting disassembly of said shank from said handle member, said disassembly means further including means for preventing axial rotation of said shank.

2. The extensible handle assembly of claim 1 wherein said rotation preventing means comprises said central hole having a flat along one side and a corresponding flat with said shank and aligned with said flat on said handle member.

3. The extensible handle assembly recited in claim 1 further comprising means for locking said disassembly means with said shank.

4. The extensible handle assembly recited in claim 1 further comprising means including said disassembly means for preventing removal of said shank from said central hole until after removal of said disassembly means.

5. The extensible handle assembly recited in claim 4 wherein said removal preventing means comprises a shoulder along the periphery of said central hole and means on said disassembly means for engaging said shoulder as said shank is pulled through said central hole of said handle member.

6. An extensive handle assembly as recited in claim 1 further comprising detent means along the periphery of said central hole of said handle member and said shank for fixing said shank in either said extended or said retracted positions.

7. The extensible handle assembly recited in claim 6 wherein said detent means comprises:

(a) a detent hole in the outer periphery of said shank adjacent said rearward end thereof;

(b) two detent recesses in the periphery of said central hole of said handle member, one of said detent recesses adjacent the rearward end of said handle member and the other adjacent the forward end thereof;

(c) a detent ball in said detent hole of said shank;

(d) a spring in said detent hole for biasing said detent ball outwardly toward said handle member; and wherein (e) said detent hole, detent recesses and said ball are aligned and dimensioned such that said ball extends into one of said recesses as said shank is moved between said extended and said retracted positions.

8. An extensible handle assembly for a ratchet wrench or the like, said handle assembly comprising:

(a) a tubular handle member having forward and rearward ends and a central hole extending down its length between said ends;

(b) a tool-engaging shank having forward and rearward ends extending through, and dimensioned to closely fit in said central hole of said handle member, said shank being longer than said handle member and said shank being slidable in said handle member between a retracted position with said rearward end of said shank adjacent said rearward end of said handle member, and an extended position with said rearward end of said shank positioned toward said forward end of said handle member;

(c) a tool-engaging member along said forward end of said shank;

(d) means extending through said central hole from said rearward end of said handle member for permitting disassembly of said shank from said handle member, said disassembly means including a plug dimensioned to be fitted into and removed from said central hole at said rearward end of said handle member and means for fastening said plug to said rearward end of said shank; and wherein (e) said central hole of said handle member includes a flat along the periphery thereof extending from said rearward end toward said forward end of said handle member, and wherein said plug includes a corresponding flat side for engaging said flat along said central hole in order to limit axial rotation of said shank relative to said handle member.

9. The extensible handle assembly recited in claim 8 further comprising means for locking said plug with said shank.

10. The extensible handle assembly recited in claim 9 wherein said locking means comprises a lock pin engaging said plug and said rearward end of said shank.

11. An extensible handle assembly for a ratchet wrench or the like, said handle assembly comprising:

(a) a tubular handle member having forward and rearward ends and a central hole extending down its length between said ends;

(b) a tool-engaging shank having forward and rearward ends extending through said central hole of said handle member, said shank being slidable in said handle member between a retracted position with said rearward end of said shank adjacent said rearward end of said handle member and an extended position with said rearward end of said shank positioned toward said forward end of said handle member;

(c) a tool-engaging member along said forward end of said shank;

(d) means extending through said central hole from said rearward end of said handle member for preventing said shank from being completely removed from said handle member through movement along said central hole, said extension preventing means further including means for preventing axial rotation of said shank; and (e) means for fastening said extension preventing means to the rearward end of said shank.

12. The extensible handle assembly recited in claim 11 wherein said extension preventing means comprises:

(a) said central hole of said handle member having a greater dimension toward said rearward end of said handle member than along said portion forwardly thereof defining a shoulder between said portions; and (b) a corresponding shoulder on said extension preventing means for engaging said shoulder of said handle member.

13. An extensible handle assembly for a ratchet wrench or the like, said handle assembly comprising:

(a) a tubular handle member having forward and rearward ends and a central hole extending down its length between said ends;

(b) a tool-engaging shank having forward and rearward ends extending through said central hole of said handle member, said shank being slidable in said handle member between a retracted position with said rearward end of said shank adjacent said rearward end of said handle member and an extended position with said rearward end of said shank positioned toward said forward end of said handle member;

(c) a tool-engaging member along said forward end of said shank;

(d) means extending through said central hole from said rearward end of said handle member for restricting axial rotation of said shank with respect to said handle member, said axial rotation restricting means including a plug fitted into said hole at said rearward end of said handle member; and (e) means for fastening said axial rotation restricting plug to said rearward end of said shank.

* * * * *